United States Patent [19]

Zent

[11] 4,071,235

[45] Jan. 31, 1978

[54] ADJUSTABLE RESISTANCE EXERCISING APPARATUS

[76] Inventor: Lawson J. Zent, 1818 Dean St., Huntington, Ind. 46750

[21] Appl. No.: 654,609

[22] Filed: Feb. 2, 1976

[51] Int. Cl.[2] ..... A63B 21/22; A63B 23/04; A63B 69/16

[52] U.S. Cl. ..... 272/73; 272/132; 272/DIG. 4; 272/DIG. 5

[58] Field of Search ..... 272/73, 116, 128, 131, 272/132, DIG. 3, DIG. 4, 72, 134, 67, 68, 72, 125, 126, 143, DIG. 5; 280/293; 128/25 R; 188/26, 72.8, 72.9; 273/183 R, 186 R, 186 A, 191 R, 193 A

[56] References Cited

U.S. PATENT DOCUMENTS

| | | | |
|---|---|---|---|
| 526,317 | 9/1894 | Hendrick et al. | 188/26 |
| 2,543,729 | 2/1951 | Magida | 272/132 |
| 3,103,357 | 9/1963 | Berne | 272/132 |
| 3,315,959 | 4/1967 | Carnielli | 272/72 |
| 3,528,653 | 9/1970 | Stuckenschneider et al. | 272/72 |
| 3,572,699 | 3/1971 | Nies | 272/73 |
| 3,653,659 | 4/1972 | Zinkin | 272/68 |
| 3,666,267 | 5/1972 | McKinney | 272/67 |
| 3,759,512 | 9/1973 | Yount et al. | 272/73 |
| 3,966,201 | 6/1976 | Mester | 272/72 |

FOREIGN PATENT DOCUMENTS

| | | | |
|---|---|---|---|
| 378,581 | 8/1932 | United Kingdom | 272/73 |
| 148,953 | 7/1920 | United Kingdom | 272/131 |

*Primary Examiner*—Richard C. Pinkham
*Assistant Examiner*—Arnold W. Kramer
*Attorney, Agent, or Firm*—Albert L. Jeffers; Roger M. Rickert

[57] ABSTRACT

A frame having a base and two horizontally spaced substantially upright elongate posts, a first of which carries a saddle seat. Mounted for rotation on the second post is a foot pedal spindle carrying first and second sprocket wheels. Also mounted for rotation on the second post is a disc spindle carrying a disc and a sprocket wheel. Mounted for rotation near the top of the second post is a hand crank spindle carrying a sprocket wheel. A drive chain is entrained over the disc sprocket wheel and the first foot pedal sprocket wheel. A second chain is entrained over the handle bar sprocket wheel and the second foot pedal sprocket wheel, which sprocket wheels are designed to provide predetermined different angular speeds to their respective spindles. A manually operable pointer is rotatably mounted on the second post to vary the spacing between two brake pads mounted on either side of the disc to provide a variable braking force to the disc corresponding to such spacing.

4 Claims, 7 Drawing Figures

ADJUSTABLE RESISTANCE EXERCISING APPARATUS

BACKGROUND OF THE INVENTION

1. Field of the Invention

This invention is in the field of kinetic in situ exercisers.

2. Description of the Prior Art

Exercising devices are well known to the art. For example, in my U.S. Pat. No. 3,213,852 entitled "EXERCISING APPARATUS" is shown a motorized exerciser that provides different rotative speeds between the hand crank arms and the the feet crank arms. My copending application Ser. No. 632,455 filed Nov. 17, 1975 entitled "EXERCISING APPARATUS" provides in a motorized exerciser a speed control for varying the rotative speeds of the hand and foot cranks, selectively reversing directions of the cranks and provides an energizing stop control. While these exercisers are admirably suited to the stretching, flexing, and relaxing of almost every body muscle, they require motor actuation and are not adapted to user control as to energy expended and development of coordination and cooperation between body movements, and are limited in muscle development.

SUMMARY OF THE INVENTION

A frame has a base and a substantially upright elongate tubular seat post for telescopically and adjustably receiving a saddle stem which carries a saddle for supporting the user. Rotatably mounted near the base end of a second frame supported upright elongate post is a foot rotated spindle which carries two sprocket wheels. Rotatably mounted to said second post intermediately of the base end and the top end thereof is a disc spindle which carries a disc sprocket wheel. Rotatably mounted near the top end of said second post is a hand rotated spindle carrying a hand sprocket wheel. A first chain entrains a first of the two foot sprocket wheels and the disc sprocket wheel and a second chain entrains the second of the two foot sprocket wheels and the hand sprocket wheel. The diameters and teeth on the sprocket wheels engaged by the second chain are such as to cause the hand spindle and foot spindle to rotate at different angular velocities, thereby providing a constantly varying relative rotative displacement between the hands and the feet.

The second post also rotatably carries a pointer shaft which has at one end a manually rotatably pointer accessible to the user and at the other end a link arm having two transversely extending stop members. Rotatably mounted between the stop members is one end of an elongate link rod, the distal end of which is connected to a first threaded element to rotate said element upon actuation of rod. A pair of adjustably spaced, parallel plates, are also supported by the second post. The inner wall of each plate carries a brake pad which pads are engageable with opposite sides of the disc and as the spacing between the plates is varied, an adjustable braking force is applied to the disc by the pads. A second element, threadedly engaged with said first element, is fixed to said plates and as the first element is rotated in relation to said second element, the spacing between said plates is varied and the braking force on said disc is varied. By manually adjusting the pointer, the braking force may be varied to adjust to user preference the effort required to turn the disc between the pads, thereby providing an exceptionally sturdy, durable, and balanced braking construction.

The link rod abuts one stop member to limit rod travel in one direction and abuts the other stop member to limit rod travel in the opposite direction, thus confining rod travel and braking force within a predetermined optimum range. Thus, a user can vary the effort expended during use, selecting the sequence of braking effort best suited to the exercise and muscle development for that particular time in the program and condition of the user. Further, since the relative hand and foot displacement is constantly changing, a greater number of muscles are used and the sequence of use is less repetitive making long periods of exercise less tiring and more beneficial.

Therefore, it is an object of this invention to provide an exerciser of sturdy construction that has a variable braking device for regulating effort required by the user.

It is an object of this invention to provide in the exerciser of the previous object, a disc mounted for rotation between two manually adjustably spaceable braking pads.

It is an object of this invention to provide a hand and foot operated exerciser wherein the relative displacement between the hand and feet positions is constantly changing.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
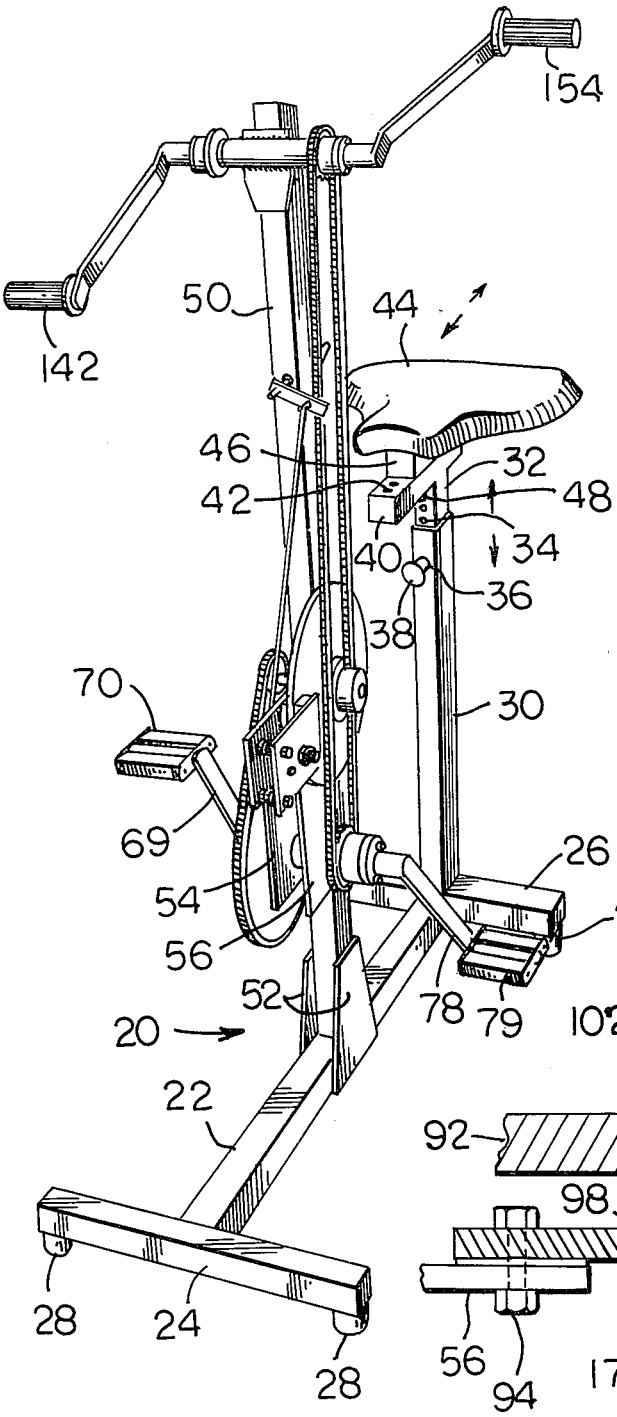
FIG. 1 is a view in perspective of a preferred embodiment of this invention.
Figure 2:
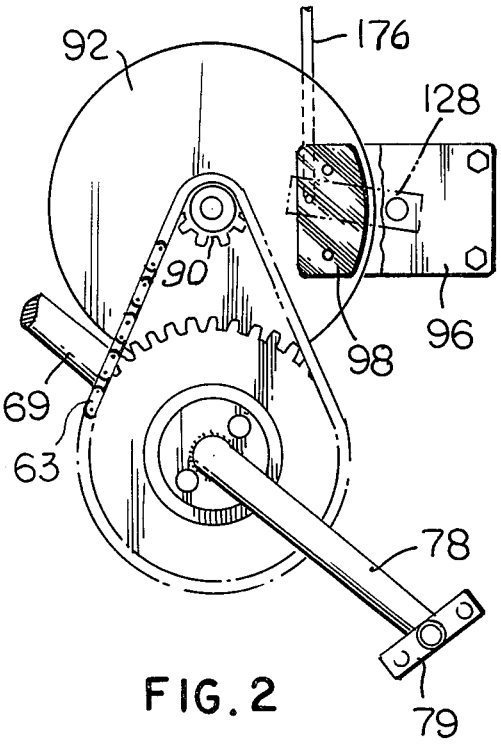
FIG. 2 is an enlarged side elevational view of the foot actuated sprocket wheel and disc sprocket wheel.

Referring to the drawings, frame 20 has an elongate horizontally disposed base strut 22 fixed, as by welding, at each end to transverse legs 24 and 26 which carry at their opposite ends feet 28 for engaging a supporting surface and are preferably of an elastic material such as rubber which will provide a stable non-moving contact with the supporting surface. Strut 22 and legs 24 and 26 are preferably of a tubular metallic construction to provide a strong, rigid support for the exerciser.

An elongate tubular post 30 is fixed as by welding to leg 26 and is substantially upright. Telescopically received in post 30 is seat seam 32 which has a plurality of threaded holes 34 formed on one side thereof. Post 30 has a threaded hole 36 which threadedly receives a bolt 38. The desired height of stem 32 in post 30 is selected and then bolt 38 is threaded through hole 36 and the hole 34 which is opposite hole 36 in the adjusted portion to securely hold stem 32 in post 30.

A transverse bar 40 is fixed, as by welding, to the upper end of stem 32 and has a plurality of spaced threaded holes 42 formed therein. A saddle seat 44 is mounted on a block 46 having a threaded hole formed therein which is registrable with holes 42. The fore and aft positions of the seat 44 is adjusted to user preference after which a bolt 48 is threaded through the hole 42 which is in registration with hole 46 and then threaded into the hole 46 to securely hold seat 44 to bar 40.

Figure 5:
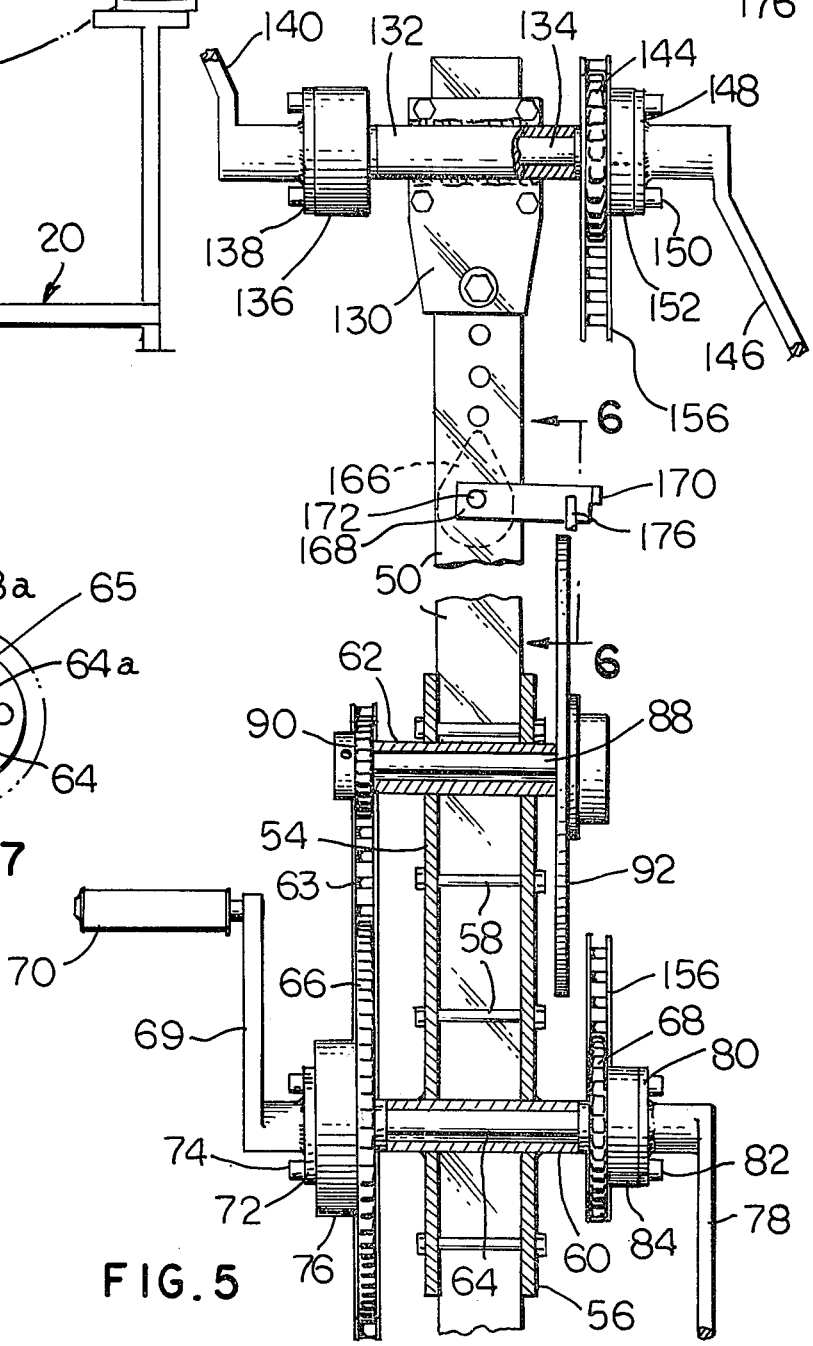
FIG. 5 is a broken, partially sectioned, view showing the mounting of the foot actuated and hand actuated sprocket wheels and the drive for the braking disc.

A second upright post 50 is securely fixed, as by welding, to frame plates 52 which in turn are welded to strut 22. Plates 54, 56 (FIG. 5) each have a plurality of holes for receiving bolts 58 and are positioned on either side of post 50 after which bolts 58 are tightened to clamp post 50 between plates 54 and 56. A transverse bushing 60 is supported as by welding to plates 54 and 56 as is transverse bushing 62 spaced vertically from bushing 60. Rotatably mounted in bushing 60 is spindle 64 which has keyed at one end thereof a first pedal actuated sprocket wheel 66 and at the other end thereof a second pedal sprocket wheel 68. A pedal crank 69 carries at one end thereof pedal 70 and is welded at the other end thereof to a disc 72 which is bolted at 74 to hub 76 of wheel 66. Similarly, a pedal crank 78 carries a pedal 79 at one end thereof, and at the other end thereof, is welded to a disc 80 which is bolted at 82 to hub 84 of wheel 68. Thus, spindle 64 may be rotated in bushing 60 by foot actuation of the pedals attached to pedal cranks 69 and 78. A spindle 88 is rotatably mounted in bushing 62 and at one end thereof is keyed to a sprocket wheel 90 and at the other end thereof to a disc 92. A chain 63 is entrained over sprocket wheels 66 and 90, to drive disc 92.

Figure 3:
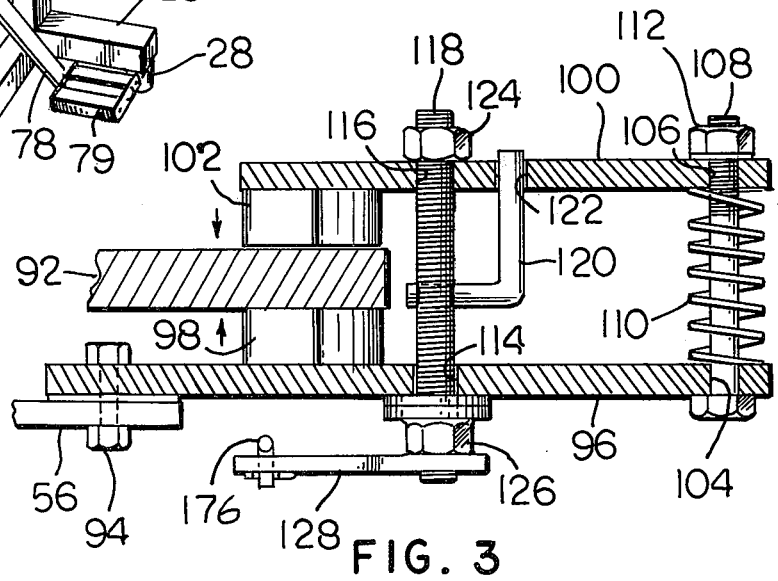
FIG. 3 is an enlarged top plan view of the brake pad support plates and variable spacing assembly.
Figure 4:
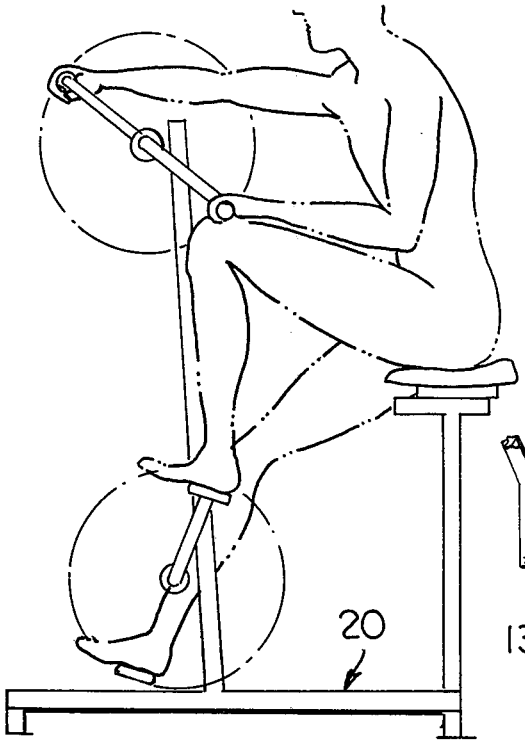
FIG. 4 is a side elevational view of the frame of the preferred embodiment shown in FIG. 1 with a user positioned thereon and shown in a typical exercising position.
Figure 6:
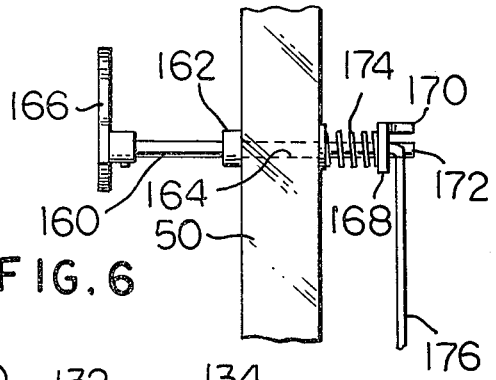
FIG. 6 is a partial section view taken at 6-6 of FIG. 5.

Bolted at 94 (FIG. 3) to plate 56 is brake pad plate 96 which carries intermediately thereof a brake pad 98. Spaced from plate 96 is a second brake pad plate 100 which carries at one end thereof a brake pad 102. Disc 92 is positioned between pads 98 and 102. Openings 104 and 106 are formed respectively in plates 96 and 100 and receive bolt 108 which supports compression spring 110. Nut 112 is threaded on bolt 108 to maintain resilient support of plates 96 and 100 in spaced relation.

Openings 114 and 116 are formed respectively in plates 96 and 100 to receive bolt 118 which has welded thereto one end of angle rod 120, the other end of which extends through an opening 122 in plate 100. This effectivly prevents bolt 118 from rotating relative plates 96 and 100. Nut 124 aids in positioning bolt 118 relative plate 100. Nut 126 is threaded at the other end of bolt 118 and is fixed as by welding to tension adjustment arm 128. Thus rotation of arm 128 will rotate nut 126 on bolt 118 to vary the spacing between plates 96 and 100 and in turn vary the braking pressure between pads 98 and 102 against disc 92.

Bolted to post 50 at its upper end is plate 130 (FIG. 5) which has welded thereto transverse bushing 132 for rotatably supporting therein hand actuated spindle 134. Keyed to one end of spindle 134 is hub 136 which carris disc 138. Crank arm 140 is fixed, as by welding, to disc 138 at one end and rotatably carries at the other end thereof hand grip 142. Keyed to the other end of spindle 134 is sprocket wheel 144. Crank arm 146 is fixed as by welding to disc 148 which is bolted at 150 to hub 152 of sprocket wheel 144. The other end of crank arm 146 rotatably supports hand grip 154. Chain 156 is entrained over sprocket wheels 144 and 68 thereby fixing in a predetermined rotational relation spindles 64 and 134. In this embodiment sprocket wheels 68 and 144 have approximately the same diameter but sprocket wheel 68 has 19 teeth whereas sprocket wheel 144 has 18 teeth. This causes a predetermined rotational difference between spindles 64 and 134 which, as will be realized, provides a constantly shifting relative displacement between hand and foot movement. This permits longer periods of exercising, places more muscles into exercising relation, reduces repetitive cycling of muscle exercise, and reduces the tiring effect of prolonged exercising.

A pin 160 having a shoulder 162 is received by opening 164 in post 50. One end of pin 160 carries pointer 166 while the other end is fixed to link arm 168 which has transversely extending stop flanges 170 and 172. Compression spring 174 operates between arm 168 and post 50 to resiliently and axially position pin 160 to post 50. Pivotally connected to arm 168 intermediately of stops 170 and 172 is elongate link rod 176 which is pivotably connected at its distal end to adjustment arm 128. Thus, rotation of pointer 166 will rotate pin 160, rotating arm 168, causing the upper end of rod 176 to move in an arcuate path about pin 160 rotating arm 128 and nut 126 to vary the spacing between braking pads 98 and 102 to in turn vary the braking force on disc 92. Thus, the manually accessible pointer 166 may be manually adjusted to regulate the breaking force applied to disc 92, and hence the exercising effort. Further, rotation of pointer 166 in a counterclockwise direction (FIG. 5) is limited when rod 176 engages stop member 172, thereby providing a counterclockwise rotational limit. Rotation of pointer 166 in the clockwise direction is limited when rod 174 engages stop member 170, thereby providing a clockwise rotational limit to pointer 166. The parameters of the system are so chosen that in one extreme rotational position of pointer 166, there will be a loose frictional coupling between disc 92 and pads 98 and 102 and on the other extreme rotational position of pointer 166, there will be a snug frictional engagement between disc 92 and pads 98 and 102. Thus, an exercising unit is provided whereby the degree of exercising may be regulated by a manually accessible pointer and may be regulated before or during the exercise period. In addition, a very stable, durable unit is provided whereby there is a constantly changing angular displacement between the relative position of the hands and feet to further muscle development and minimize tiring during long exercise periods.

Figure 7:
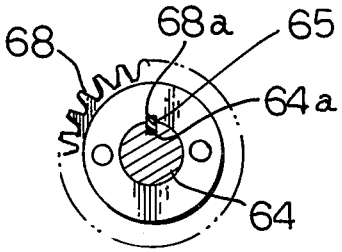
FIG. 7 is a view of a sprocket wheel keyed to a spindle.

Referring to FIG. 7, sprocket wheel 68 has notch **68*a* for receiving key 65. Spindle 64 has notch 64*a* for receiving key 65. In this manner, wheel 68 and spindle 64** are in keyed relation and other spindles are similarly keyed to their respective wheels and discs.

Modifications may be made within the scope of the appended claims.

While there have been described above the principles of this invention in connection with specific apparatus, it is to be clearly understood that this description is made only by way of example and not as a limitation to the scope of the invention.

What is claimed is:

1. A user actuated exercising apparatus comprising:

means for rotatably supporting a disc;

a braking pad mounted to frictionally engage said disc and provide a braking force to said disc;

manually actuated means for varying the magnitude of said braking force by said pad on said disc;

user operated means for providing rotation of said disc against said variable braking force, said braking pad being engageable with a first disc side at the disc periphery;

a second braking pad spaced from and oppositely supported to said braking pad and engageable with said second disc side;

said manually actuated means comprising spaced means to vary the spacing between said pads to vary the braking force on said disc;

a first disc plate carrying at one end thereof said braking pad;

a second disc plate carrying at one end thereof said second braking pad; a spring being mounted to resiliently support said second plate relative to said first plate;

said spacing means varying the spacing between said plates relative one another against the force of said spring to vary the braking force applied by said pads to said disc, said manually actuated means comprises a rotatably mounted manually operated pointer, an elongate threaded member extending through said plates and held against rotation relative to said first and second disc plates; a nut in threaded engagement with said threaded member and operable against one of said plates on rotation relative thereto; a link assembly being attached to said pointer and said nut to rotate said nut upon rotation of said pointer to thereby vary the braking force on said disc.

2. The apparatus of claim 1 wherein said link assembly comprises an arm rotatably with said pointer, an elongate rod pivotably connected to said arm; a pair of stop members extending from said arm on either side of the pivotal connection of said rod to said arm; said stop members engageable with opposite sides of said rod for limiting rotation of said arm to a predetermined arcuate travel.

3. The apparatus of claim 1 including:

said user operated means rotatably supporting a foot actuated spindle;

means for rotatably supporting a hand actuated spindle spaced from said last mentioned means; and means for interconnecting the rotation of said foot actuated spindle and said hand actuated spindle so that said foot actuated spindle and said hand actuated spindle are rotated at different angular speeds.

4. An exerciser apparatus according to claim 3 wherein:

said last mentioned means comprises a first sprocket wheel mounted to and rotatably by said foot actuated spindle;

a second sprocket wheel mounted to and rotatable by said hand actuated spindle;

a chain member entrained on said first and second sprocket wheels; the number of teeth on said first sprocket wheel being different than the number of teeth on said second sprocket wheel.

* * * * *

UNITED STATES PATENT AND TRADEMARK OFFICE

CERTIFICATE OF CORRECTION

PATENT NO. : 4,071,235

DATED : January 31, 1978

INVENTOR(S) : Lawson J. Zent

It is certified that error appears in the above-identified patent and that said Letters Patent are hereby corrected as shown below:

Col. 2, line 67, "seam" should be -- stem --

Col. 3, line 4, "portion" should be -- position --

Col. 3, line 11, "positions" should be -- position --

Col. 4, line 38, "174" should be -- 176 --

Col. 5, line 12 (Claim 1) "spaced" should be -- spacing --

Col. 6, line 24 (Claim 4) "rotatably" should be -- rotatable --

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*